US005813214A

United States Patent [19]

Moniz et al.

[11] Patent Number: 5,813,214

[45] Date of Patent: Sep. 29, 1998

[54] BEARING LUBRICATION CONFIGURATION IN A TURBINE ENGINE

[75] Inventors: Thomas Moniz, Loveland; Ambrose A. Hauser, Wyoming; Jorge F. Seda, Cincinnati, all of Ohio

[73] Assignee: General Electric Company, Cincinnati, Ohio

[21] Appl. No.: 778,597

[22] Filed: Jan. 3, 1997

[51] Int. Cl.[6] ..... F02C 7/06

[52] U.S. Cl. ..... 60/39.08; 415/175

[58] Field of Search ..... 60/39.08, 39.161; 415/69, 175; 184/6.11

[56] References Cited

U.S. PATENT DOCUMENTS

| | | | |
|---|---|---|---|
| 3,531,935 | 10/1970 | Poucher | 60/39.08 |
| 3,844,110 | 10/1974 | Widlansky et al. | 60/39.08 |
| 3,903,690 | 9/1975 | Jones | 60/39.08 |
| 4,086,759 | 5/1978 | Karstensen et al. . | |
| 4,137,705 | 2/1979 | Andersen et al. | 60/39.08 |
| 4,378,197 | 3/1983 | Cattaneo et al. . | |
| 4,500,143 | 2/1985 | Kervistin et al. . | |
| 4,502,274 | 3/1985 | Girault . | |
| 4,683,714 | 8/1987 | Thebert . | |
| 4,856,273 | 8/1989 | Murray . | |

*Primary Examiner*—Louis J. Casaregola
*Attorney, Agent, or Firm*—Andrew C. Hess; Nathan D. Herkamp

[57] ABSTRACT

A turbine engine including an oil flow path through the low pressure system shaft which, as compared to at least one known oil flow path, facilitates increasing the rated torque and life of the low pressure system shaft is described. In one embodiment, the lubrication opening in the low pressure shaft is oriented so that with respect to a plane along which an outer surface of the low pressure shaft substantially extends, the center axis of the lubrication opening is substantially normal to the plane. As a result of this configuration, the stress concentration in the low pressure shaft at the location of the lubrication opening is substantially reduced. In addition, such a lubrication opening is relatively easy to form as compared to the known, angularly oriented lubrication shaft. Further, the lubrication opening in the present configuration can have a larger diameter than the known angularly oriented lubrication opening due to the reduced stress concentration, and such a larger lubrication opening facilitates more free flow of lubrication through the opening to the differential bearing.

12 Claims, 2 Drawing Sheets

BEARING LUBRICATION CONFIGURATION IN A TURBINE ENGINE

FIELD OF THE INVENTION

This invention relates generally to turbine engines and more particularly, to providing improved differential bearing lubrication in a turbine engine.

BACKGROUND OF THE INVENTION

Turbine engines generally include a high pressure compressor for compressing air flowing through the engine, a combustor in which fuel is mixed with the compressed air and ignited to form a high energy gas stream, and a high pressure turbine. The high pressure compressor, combustor and high pressure turbine sometimes are collectively referred to as the core engine. Such engines also may include a low pressure compressor, or booster, for supplying compressed air, for further compression, to the high pressure compressor.

Many of the above described engine components are supported by bearings within an outer case, and the bearings require lubrication. Oil typically is supplied to the bearings through various routes in the engine. For example, in one known engine, a lubrication opening is formed in the low pressure system drive shaft, and lubrication flows through one of the openings to a differential roller bearing which supports the high pressure system shaft. The opening in the low pressure system drive shaft is oriented angular relative to the outer surface of the shaft.

With some newer engines, the engine thrust is significantly increased as compared to earlier engines. As the engine thrust increases, corresponding drive shaft torque increases which, in turn, increases the stress on the drive shaft. The opening in the low pressure system drive shaft, however, reduces the amount of stress that can be applied to the shaft without potential failure. Specifically, in the above described engine, the angularly oriented oil supply opening in the low pressure shaft is the torque and life limiting element of the shaft.

It would be desirable to increase both the rated torque and life of the low pressure shaft without significantly increasing the shaft fabrication costs, in terms of both material and labor. It also would be desirable to provide such an increased rated torque and life yet not adversely affect the amount of lubrication provided to the differential bearing supporting the high pressure system shaft.

SUMMARY OF THE INVENTION

These and other objects may be attained by a turbine engine including an oil flow path through the low pressure system shaft which, as compared to at least one known oil flow path, facilitates increasing the rated torque and life of the low pressure system shaft. Particularly, and in one embodiment, the lubrication opening in the low pressure shaft is oriented so that with respect to a plane along which an outer surface of the low pressure shaft substantially extends, the center axis of the lubrication opening is substantially normal to the plane. As a result of this configuration, the stress concentration in the low pressure shaft at the location of the lubrication opening is substantially reduced. In addition, such a lubrication opening is relatively easy to form as compared to the known, angularly oriented lubrication shaft. Further, the lubrication opening can have a larger diameter than the known lubrication opening due to the reduced stress concentration, and such a larger lubrication opening facilitates more free flow of lubrication through the opening to the differential bearing.

More particularly, and in one embodiment, the turbine engine includes an outer case, a high pressure system shaft supported in the case, and at least one differential bearing including an inner race and an outer race. The high pressure shaft is supported within the case on the inner race. The engine further includes a low pressure system shaft supported within the case. A plurality of seals are provided for containing oil within a region occupied by the differential bearing supporting the high pressure system shaft.

With respect to the oil flow path, a lubrication opening is located in the low pressure system shaft, and the lubrication opening has a center axis which is substantially normal to a plane along which an outer surface of the low pressure shaft extends. In addition, a lubrication opening is located in the high pressure system shaft, and the lubrication opening has a center axis which is substantially normal to a plane along which an outer surface of the high pressure shaft extends.

In operation, oil flows longitudinally from a first region within the case to a first oil reservoir located at the low pressure shaft lubrication opening. Due to the centrifugal forces within the shaft, the oil in the first reservoir is forced to flow radially outward through the low pressure shaft lubrication opening, and then along a path to a second oil reservoir. The second oil reservoir is located below the lubrication opening in the high pressure shaft. Again due to centrifugal forces, oil in the second oil reservoir flows through the lubrication opening in the high pressure system shaft and to the bearing. The seals provide that in operation, the oil is directed to flow from a second region at the differential bearing to the first region. The oil once again flows longitudinally from the first region to the low pressure shaft lubrication opening, and the cycle is repeated.

As explained above, by eliminating the angularly oriented lubrication opening in the low pressure shaft, and by using a low pressure shaft lubrication opening as described above, the rated torque and life of the low pressure system shaft is increased. Particularly, by orienting the lubrication opening in the low pressure shaft so that with respect to a plane along which an outer surface of the low pressure shaft substantially extends, the center axis of the lubrication opening is substantially normal to the plane, the stress concentration in the low pressure shaft at the location of the lubrication opening is substantially reduced. Also, since the lubrication opening is located at a lower stress region, the opening can have a large diameter, which facilitates improved flow of lubrication to the differential bearing. In addition, and with respect to fabrication, the present lubrication opening in the low pressure shaft is much easier to form than the known angularly oriented opening, and the time and costs associated with forming the present low pressure shaft lubrication opening are believed to be significantly less than the time and costs associated with formation of the angularly oriented lubrication opening.

DETAILED DESCRIPTION OF THE DRAWINGS

Figure 1:
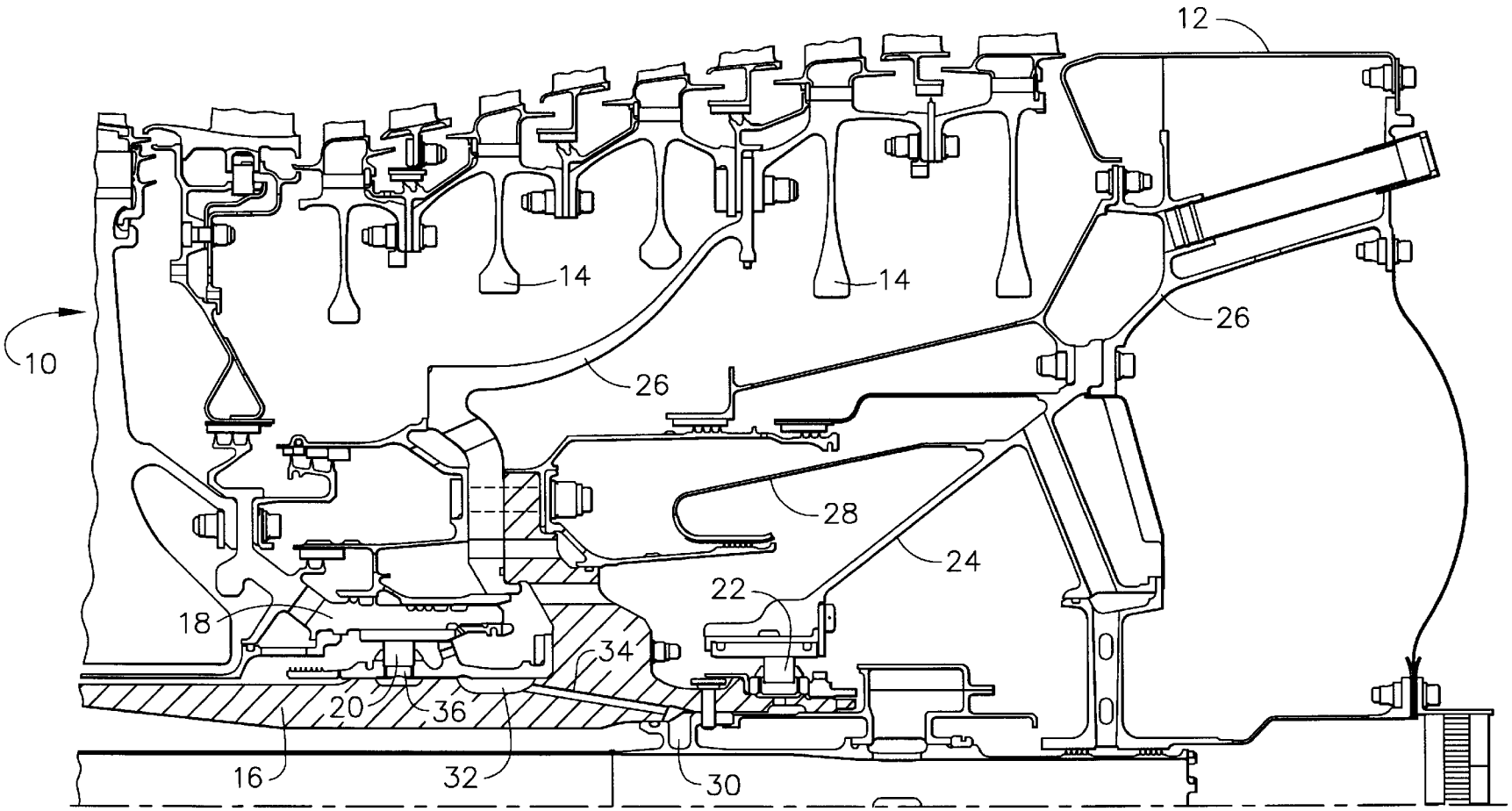
FIG. 1 (PRIOR ART)
FIG. 1 is a schematic illustration of a portion of a known gas turbine engine including a known lubrication route.

FIG. 1 is a schematic illustration of a portion of a known gas turbine engine 10 including a known lubrication route which is described hereinafter in more detail. As is well known, engine 10 includes an outer case 12, and various engine components are supported by, and within, outer case 12. For example, air control vanes 14 are coupled to outer case 12 and extend within case 12 into the air flow path. Engine 10 also includes a low pressure shaft 16 and a high pressure shaft 18. Shafts 16 and 18 are supported on bearings 20 and 22. Bearings 20 and 22, including a bearing housing 24, are secured to a frame 26. A plurality of seals 28 also are provided for containing lubrication within desired regions in engine 10.

An oil flow path for providing oil to differential bearing 20 includes a first oil reservoir 30, a second oil reservoir 32, and an angular lubrication opening 34 in low pressure shaft 16. Angular opening 34 extends from first oil reservoir 30 to second oil reservoir 32.

In operation, oil flows into and fills first oil reservoir 30. Due to centrifugal forces, oil within first oil reservoir 30 flows through lubrication opening 34 in low pressure shaft 16. Oil then flows from second oil reservoir 32 to an inner race 36 of bearing 20.

Although the above described lubrication route provides sufficient lubrication for bearing 20, with some newer engines, the engine thrust is significantly increased as compared to earlier engines. As the engine thrust increases, the stress on low pressure drive shaft 16 also increases. Angular opening 34 in low pressure system drive shaft 16, however, reduces the amount of stress that can be applied to shaft 16 without potential failure. Specifically, angularly oriented oil supply opening 34 in the low pressure shaft 16 is the torque and life limiting element of shaft 16.

Figure 2:
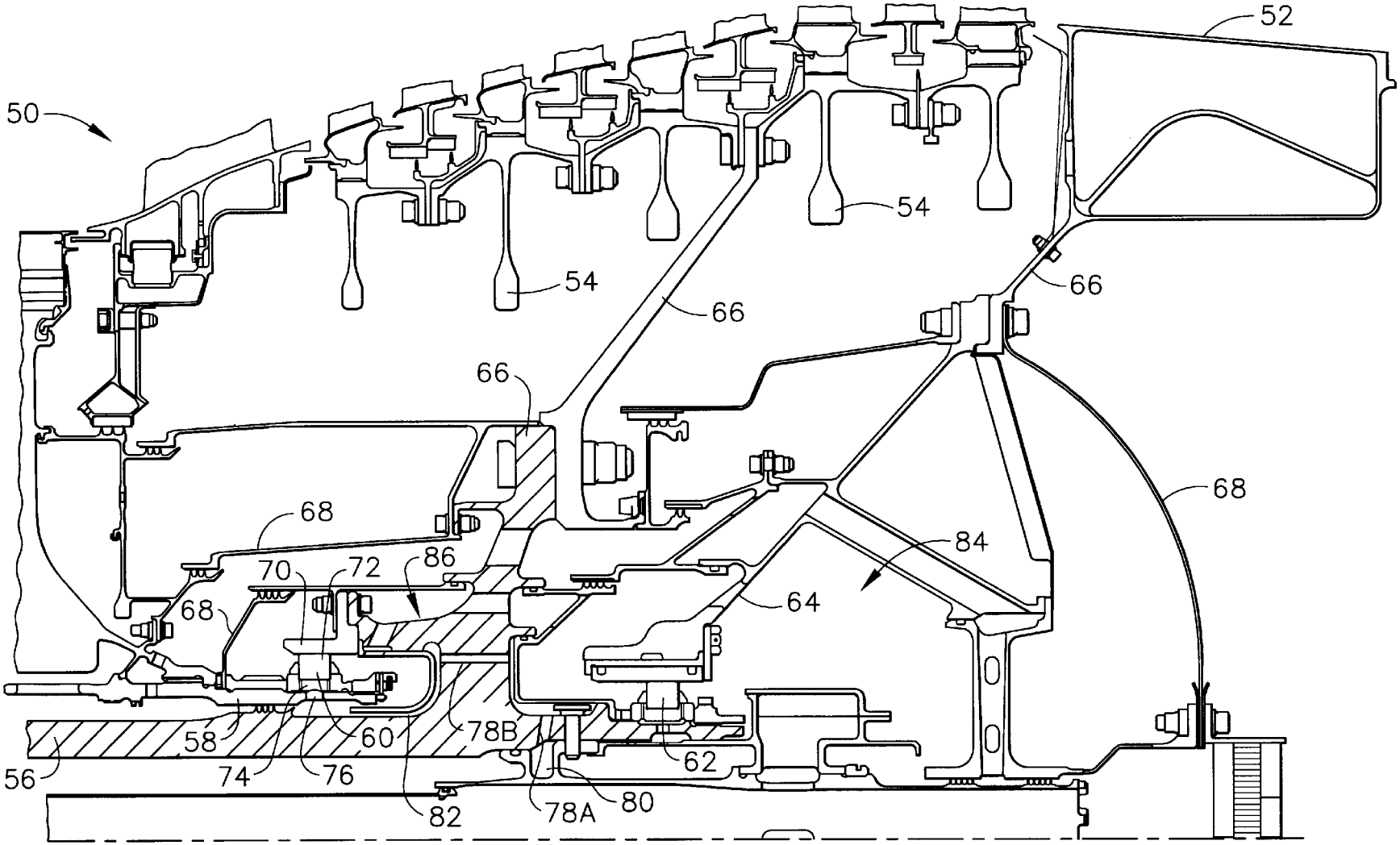
FIG. 2 is a schematic illustration of a portion of a gas turbine engine including a lubrication route in accordance with one embodiment of the present invention.

FIG. 2 is a schematic illustration of a portion of a gas turbine engine 50 including a lubrication route in accordance with one form of the present invention. As with engine 10, engine 50 includes an outer case 52, and various engine components are supported by and within outer case 52. For example, air control vanes 54 are coupled to outer case 52 and extend within case 52 into the air flow path. Engine 10 also includes a low pressure shaft 56 and a high pressure shaft 58. Shafts 56 and 58 are supported on differential bearing 60, e.g., a roller bearing, and bearing 62. Bearings 60 and 62 including a bearing housing 64, are secured to a frame 66. A plurality of seals 68 also are provided for containing lubrication within desired regions in engine 50.

In engine 50, and with respect to differential bearing 60 supported on a flanged outer bearing race 70, such bearing includes a roller 72 and an inner race 74. High pressure system shaft 58 is supported on, and rotates relative to outer bearing race 70. A lubrication opening 76 is formed in high pressure system shaft 58, and lubrication opening 76 has a center axis (not shown) which is substantially normal to a plane along which an outer surface of high pressure shaft 58 extends.

In addition, lubrication openings 78A and 78B are located in low pressure shaft 56. Lubrication opening 78 has a center axis (not shown) which is substantially normal to a plane along which an outer surface of low pressure shaft 56 extends. Lubrication opening 78B has a center axis which is substantially parallel to a plane along which an outer surface of low pressure shaft 56 extends. By orienting openings 78A and 78B as described rather than having angular opening 34 as described in connection with engine 10 (FIG. 1), the stress concentrations at the locations of lubrication openings 78A and 78B are substantially reduced compared to the stress concentration at angular lubrication opening 34 (FIG. 1). Further, since lubrication openings 78A and 78B are located at a lower stress region, openings 78A and 78B can have larger diameters, which facilitates improved flow of oil through lubrication route to differential bearing. Lubrication openings 78A and 78B also are much easier to form than angularly oriented opening 34, which facilitates reducing fabrication time and costs.

The lubrication route in engine 50 includes a first oil reservoir 80, openings 78A and 78B through low pressure shaft 56, a second oil reservoir 82, and opening in high pressure system shaft 58. More particularly, and in operation, oil flows longitudinally from a first region 84 within outer case 52 to first oil reservoir 80. Due to the centrifugal forces, the oil in first oil reservoir 80 flows radially outward through low pressure shaft lubrication opening 78A, and then along a path through opening 78B to second oil reservoir 82. Once oil reservoir 82 fills, oil in second oil reservoir 82 flows through lubrication opening 76 in high pressure system shaft 58 and to differential bearing 60 in a second region 86. Seals 68 contain oil within first and second regions 84 and 86, and provide that in operation, the oil is directed to flow from second region 86 at differential bearing 60 back to the first region 84 and returns to the oil tank (not shown). The oil once again is supplied at pressure to the lube circuit and flows longitudinally from first region 84 to low pressure shaft lubrication opening 78A, and the cycle is repeated.

By eliminating angularly oriented lubrication opening 34, and by using low pressure shaft lubrication openings 78A and 78B, the rated torque and life of low pressure system shaft 56 is increased. Therefore, low pressure shaft 56 can be operated at higher torques and stresses than other known low pressure shafts. Also, since lubrication openings 78A and 78B are located at a lower stress region, openings 78A and 78B can have large diameters, which facilitates improved flow of lubrication to differential bearing 60 and further facilitates operating low pressure shaft 56 at a higher torque.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A turbine engine comprising:

an outer case;

a high pressure system shaft;

at least one bearing supporting said high pressure system shaft;

a low pressure system shaft supported within said case, at least one lubrication opening in said low pressure system shaft, said lubrication opening having a center axis which is substantially normal to a plane along which an outer surface of said low pressure shaft extends; and a plurality of seals for containing oil within a region occupied by said bearing.

2. A turbine engine in accordance with claim 1 wherein said bearing is supported on a flanged outer bearing race, and said bearing comprises a roller race and an inner race.

3. A turbine engine in accordance with claim 2 wherein said high pressure system shaft is supported on said outer bearing race.

4. A turbine engine in accordance with claim 3 further comprising a lubrication opening in said high pressure system shaft, said lubrication opening having a center axis which is substantially normal to a plane along which an outer surface of said high pressure shaft extends.

5. A turbine engine in accordance with claim 1 wherein said bearing is a roller bearing.

6. A turbine engine comprising:

an outer case;

a high pressure system shaft, a lubrication opening in said high pressure system shaft, said lubrication opening having a center axis which is substantially normal to a plane along which an outer surface of said high pressure shaft extends;

at least one bearing supporting said high pressure system shaft;

a low pressure system shaft supported within said case, a lubrication opening in said low pressure system shaft, said lubrication opening having a center axis which is substantially normal to a plane along which an outer surface of said low pressure shaft extends; and a second lubrication opening in said low pressure system shaft, said second lubrication opening having a center axis substantially parallel to a plane along which an outer surface of said low pressure shaft extends.

7. A turbine engine in accordance with claim 6 wherein said bearing comprises a flanged outer bearing race, and said engine further comprises a differential bearing supported on said outer bearing race, said differential bearing comprising a roller race and an inner bearing race.

8. A turbine engine in accordance with claim 7 wherein said high pressure system shaft is supported on said flanged outer bearing race.

9. A turbine engine in accordance with claim 6 wherein said bearing is a roller bearing.

10. A turbine engine in accordance with claim 6 further comprising a plurality of seals for containing oil within a region occupied by said bearing.

11. A turbine engine comprising:

an outer case;

a high pressure system shaft, a lubrication opening in said high pressure system shaft, said lubrication opening having a center axis which is substantially normal to a plane along which an outer surface of said high pressure shaft extends;

at least one bearing comprising a flanged outer bearing race, said high pressure system shaft supported on said outer bearing race;

a low pressure system shaft supported within said case, a first lubrication opening in said low pressure system shaft, said first lubrication opening having a center axis which is substantially normal to a plane along which an outer surface of said low pressure shaft extends; and a plurality of seals for containing oil within a region occupied by said bearing.

12. A turbine engine in accordance with claim 11 further comprising a second lubrication opening in said low pressure system shaft, said second lubrication opening having a center axis substantially parallel to a plane along which an outer surface of said low pressure shaft extends.

* * * * *